United States Patent [19]

Roberts et al.

[11] Patent Number: 4,840,503

[45] Date of Patent: Jun. 20, 1989

[54] STUFFED CHAMBER RIBBON CARTRIDGE

[75] Inventors: Sheldon D. Roberts, Versailles; Louann B. Samuels, Scott County; David T. Shadwick, Lexington, all of Ky.

[73] Assignee: International Business Machine Corporation, Armonk, N.Y.

[21] Appl. No.: 175,893

[22] Filed: Mar. 31, 1988

[51] Int. Cl.[4] ..... B41J 35/28

[52] U.S. Cl. ..... 400/208; 400/196

[58] Field of Search ..... 400/194, 195, 196, 196.1, 400/208

[56] References Cited

U.S. PATENT DOCUMENTS

| | | | |
|---|---|---|---|
| 3,814,231 | 6/1974 | Cappotto | 197/168 |
| 3,974,906 | 8/1976 | Lee et al. | 197/168 |
| 3,989,132 | 11/1976 | Carson, Jr. | 197/168 |
| 3,994,383 | 11/1976 | Best | 197/168 |
| 4,053,042 | 10/1977 | Hess | 197/168 |
| 4,130,367 | 12/1978 | Guerrini et al. | 400/195 |
| 4,131,372 | 12/1978 | Hengelhaupt | 400/196.1 |
| 4,229,112 | 10/1980 | Schaefer | 400/196.1 |
| 4,232,976 | 11/1980 | Bernardes et al. | 400/196.1 |
| 4,325,645 | 4/1982 | Miyajima et al. | 400/196.1 |
| 4,388,006 | 6/1983 | Waibel | 400/195 |
| 4,405,247 | 9/1983 | Hanna | 400/196.1 |
| 4,465,388 | 8/1984 | Iwasawa | 400/197 X |
| 4,523,868 | 6/1985 | Shadwick | 400/208 |
| 4,534,667 | 8/1985 | Bury | 400/207 |
| 4,538,931 | 9/1985 | Nagashima | 400/185 |
| 4,616,942 | 10/1986 | Nagasawa et al. | 400/196.1 |
| 4,623,274 | 11/1986 | Ohsaki | 400/208 |
| 4,645,363 | 2/1987 | Andersson | 400/196.1 |
| 4,749,293 | 6/1988 | Beer et al. | 400/196.1 |

FOREIGN PATENT DOCUMENTS

| | | | |
|---|---|---|---|
| 19649 | 12/1980 | European Pat. Off. | 400/196.1 |
| 53042 | 6/1982 | European Pat. Off. | 400/196.1 |
| 56-290 | 4/1982 | Japan | 400/196.1 |
| 152481 | 7/1986 | Japan | 400/196.1 |
| 1347636 | 2/1974 | United Kingdom | 400/196.1 |
| 2184998 | 7/1987 | United Kingdom | 400/196.1 |

OTHER PUBLICATIONS

"Harmonic-Drive Ribbon Stuffer for Impact Printers", Helinski, IBM J. Res. Develop., vol. 23, No. 4, Jul. 1979, pp. 411–414.

IBM Tech. Disc. Bulletin, "Ribbon Cartridge Exit Impedance", vol. 20, No. 11B, Apr. 1978, pp. 4739–4740.

Research Disclosure article No. 28058 entitled, "Cartridge Ribbon Restraint System", Aug. 1987, No. 280, Kenneth Mason Publications Ltd.

*Primary Examiner*—Edgar S. Burr
*Assistant Examiner*—James R. McDaniel
*Attorney, Agent, or Firm*—John A. Brady

[57] ABSTRACT

A fabric ribbon (13) is stuffed in a cartridge chamber (11). Two pinch rollers (35 and 39) are driven by a third roller (29). The direction for forces from the pinch rollers is toward a wall portion (9a), which is near an opening having a dam (ridge 67) which leads to chamber (74) have an exit slot (71) located near the wall portion (9a). The drive roller (29) is positioned to be located where the drive roller of an existing cartridge was located, making this cartridge interchangeable with a cartridge for a spool-to-spool ribbon.

5 Claims, 3 Drawing Sheets

STUFFED CHAMBER RIBBON CARTRIDGE

TECHNICAL FIELD

This invention relates to printer ribbon cartridges of the kind in which ribbon is stored in a tightly filled chamber with used ribbon forced into the chamber by pinch rollers while ribbon to be used is pulled from another location in the chamber. The ribbon typically forms a zigzag configuration within the chamber.

BACKGROUND ART

This invention employs nip or pinch rollers to force or stuff ribbon into a chamber, the rollers having stripper members on the side toward the chamber to assure that the ribbon enters the chamber rather than winding around the rollers. Such configurations are conventional. The following prior art is illustrative of pinch rollers in such stuffer cartridges, all typically having associated stripper members: U.S. Pat. Nos. 4,538,931 (particularly FIG. 10) to Nagashima, 4,534,667 to Bury, 4,405,247 to Hanna, 4,232,976 to Bernardis et al, 4,229,112 to Schaefer, 4,131,372 to Hengelhaupt, 4,130,367 to Guerrini et al, 4,053,042 to Hess, 3,994,383 to Best, 3,989,132 to Carson, and 3,974,906 to Lee et al.

This invention employs a dam constricting ribbon movement for metering ribbon. Such dams are generally conventional. The following prior art is illustrative of such dams: two U.S. Patents listed above as follows: Nos. 4,232,976 and 3,989,132 and also U.S. Pat. No. 3,814,231 to Cappotto. U.S. Pat. Nos. 4,616,942 to Nagasawa et al and No. 4,388,006 to Waibel show exit chambers defined by a single dam. Ribbon leaves these exit chambers in single strands through an exit slot. This invention has such an exit chamber in close proximity to a wall member situated in the line of force of the drive rollers. In the foregoing 4,388,006 the direction of force appears to be toward the dam, rather than toward a wall member.

The foregoing 4,616,942 has three rollers in the cartridge and a direction of force from the pinch rollers which is toward a wall near the dam. This invention has such a configuration. However, the exit slot is on the side of the exit chamber away from the wall and the dam is perpendicular to the wall, configurations basically opposite from those of this invention. Additionally, the drive roller in this patent borders on the chamber stuffed with ribbon, while in this invention the drive roller is away from the stuffed chamber.

Stuffed cartridge configurations in which nip rollers drive generally toward exit slots are conventional. U.S. Pat. Nos. 4,645,363 to Andersson; 4,623,274 to Ohsaki, 4,465,388 to Iwasawa and 4,325,645 to Miyajima are illustrative. Research Disclosure article No. 28058 entitled "Cartridge Ribbon Restraint System", August 1987, No. 280, Kenneth Mason Publications Ltd., England shows pinch rollers directed toward top and bottom bosses in a stuffed ribbon cartridge.

This invention provides a ribbon stuffer cartridge which operates in the same mechanism of a printer as a spool-to-spool feed cartridge carrying ribbon to be used only once. U.S. Pat. No. 4,131,372, listed above, is of general interest in this respect for its showing of a fabric ribbon cartridge which is driven by a printer with mechanism which also drives a cartridge with another kind of ribbon.

The cartridge of this invention is the same size and general shape as an existing spool-to-spool ribbon cartridge, for example, the cartridge of U.S. Pat. No. 4,523,868 to Shadwick. The drive roller of this cartridge is positioned to be located where the drive roller of such existing cartridge is located, and this cartridge is otherwise compatible with the ribbon feed mechanism of the existing cartridge. This cartridge is therefore interchangeable with such existing cartridge for use on a printer, which was an essential design objective of this cartridge.

DISCLOSURE OF THE INVENTION

This is a stuffer cartridge for a fabric ribbon having a ribbon-storage chamber with a single dam which defines one side of an exit chamber, a barrier wall immediately contiguous to the dam opposite the direction of force of nip or pinch rollers, an exit slot in the exit chamber near the barrier wall, and a drive roller meshing with one of the pinch rollers. The cartridge has spaced guide arms, and the pinch rollers and drive roller are on the side of the cartridge opposite the guide arms. The drive roller permits the pinch rollers to be spaced away from the machine drive point.

As discussed in the foregoing under "Background Art", an important advantage of this cartridge is that it is interchangeable with a spool-to-spool cartridge for use on same printer.

BRIEF DESCRIPTION OF THE DRAWING

This invention will be described employing the accompanying drawing in which.

BEST MODE FOR CARRYING OUT THE INVENTION

Figure 1:
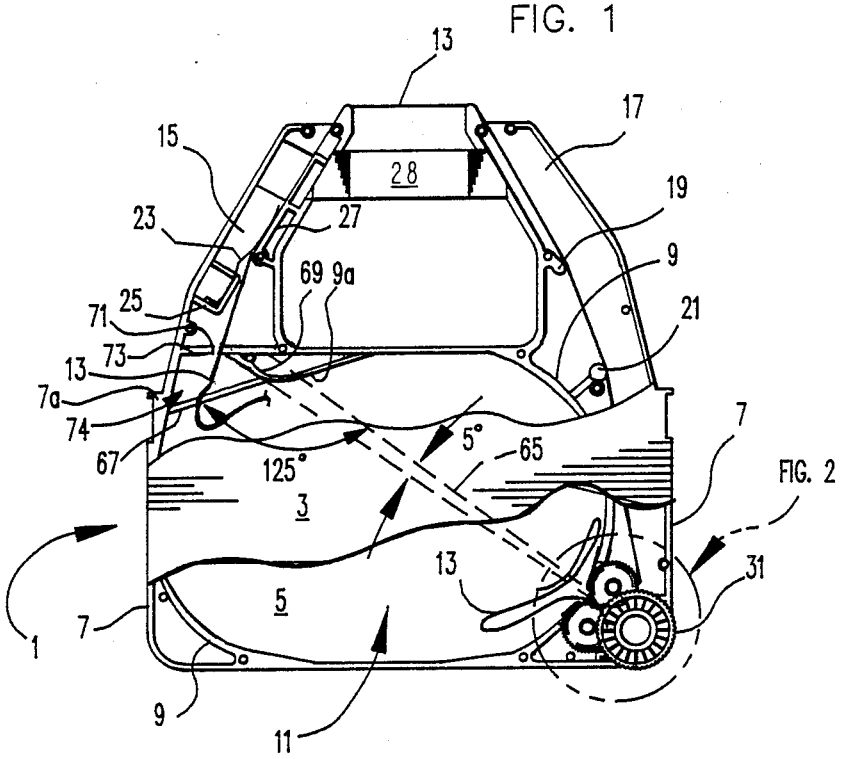
FIG. 1 is a top view of the cartridge as it would be mounted for use in a printer with most of the covers broken away.

FIG. 1 shows the ribbon cartridge 1 of this invention having a top wall or cover 3 (largely not shown) and a bottom wall or cover 5 as well as parallel side walls 7 which form a largely closed cartridge 1 with top wall 3 parallel to bottom wall 5.

An internal wall 9 extends between top wall 3 and bottom wall 5 to form a chamber 11 in which conventional woven fabric printer ribbon 13 is tightly forced or stuffed. Cartridge 1 has ribbon guide arm 15 from which ribbon 13 exits chamber 11 and opposing ribbon guide arm 17 through which ribbon again enters cartridge 1 and contacts a guide post 19 in guide arm 17 and then contacts guide post 21 outside of chamber 11. A flat spring 23 of the approximate width of ribbon 13 is held in guide arm 15 by being positioned in notches in a hollow, rectangular post 25 so that the flat surface of spring 23 presses ribbon 13 against a flat surface 27 in arm 15, to frictionally meter exit of ribbon 13 as is essentially conventional. Arm 15 and arm 17 are connected by a bracket 28 to provide added physical stability.

Drive roller 29 (FIG. 2) having a top flange 31 is mounted across from entrance arm 15 at the corner of cartridge 1 opposite arm 17. Drive roller 29 (FIG. 2) has top flange 31 (shown partially in phantom in FIG. 2) for manual feeding of ribbon 13. Roller 29 has teeth 33 which drive a pinch roller 35 by meshing with the teeth 37 of roller 35. A pinch roller 39 has teeth 41 which engage and mesh with teeth 37. Pinch rollers 35 and 39 are identical. The teeth 33, 37 and 41 all have the same standard involute gear profile in cross section. Involute teeth do not have pointed ends, which tend to fold the ribbon. The involute profile provides constant speed and force between meshed teeth, as is well established.

Ribbon 13 is pinched or nipped between roller 35 and roller 39 where teeth 37 and 41 come together. Teeth 37 of roller 35 engage with and mesh with teeth 33 of drive roller 29, while roller 39 and roller 29 are separated, permitting ribbon 13 to be guided by the surface of teeth 41 to where ribbon 13 is pinched between roller 35 and roller 39.

Figure 3:
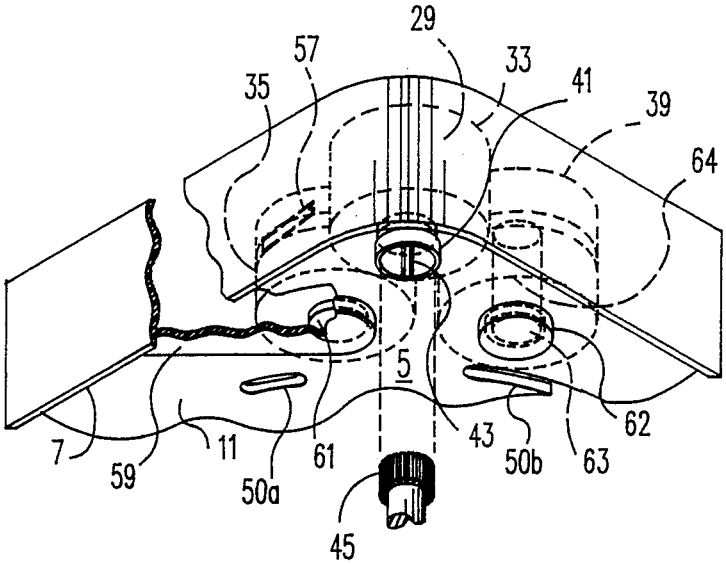
FIG. 3 is a perspective view from the bottom in the area of the drive roller and pinch rollers.

As best shown in FIG. 3, drive roller 29 has a cylindrical extension 41 which extends out of the bottom wall 5 of cartridge 1. Extension 41 has internal, closely spaced ridges 43 extending longitudinally along the internal axis of extension 41 from the lower edge, suited to receive a drive member 45 of a printer to which cartridge 1 is installed for use. Extension 41 and its cooperation with drive member 45 is identical to existing subject matter for which it was a design objective that this cartridge be compatible.

Figure 2:
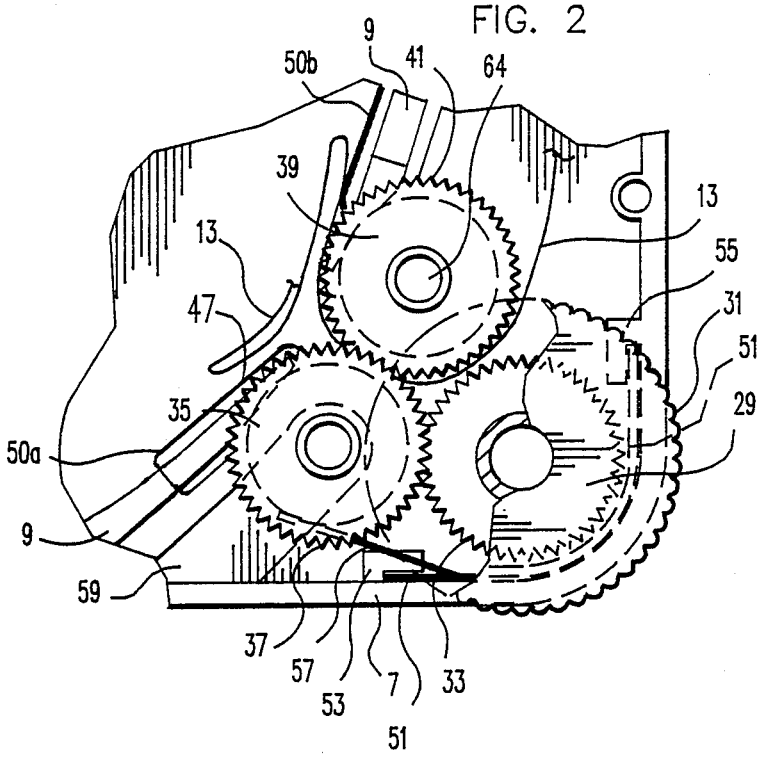
FIG. 2 is an enlargement of the drive and pinch rollers area of FIG. 1 with the top cover removed.
Figure 4:
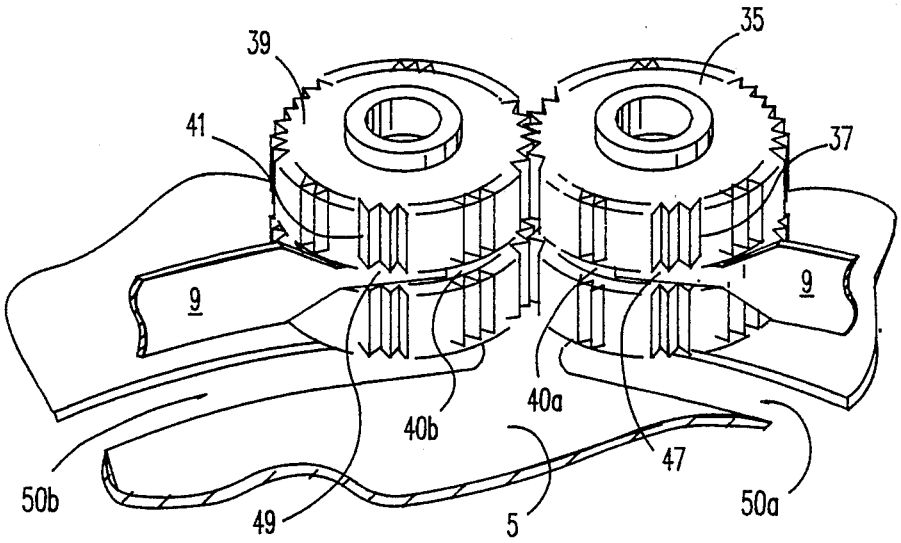
FIG. 4 is a perspective view toward the pinch rollers.

As shown in FIG. 4 rollers 35 and 39 have central regions 40*a*, 40*b* respectively having no teeth 37, 41, and wall 9 forms spaced abutments 47 and 49 occupying those central regions 40*a*, 40*b* respectively. Abutments 47 and 49 are strippers which prevent ribbon 13 from wrapping around either of the rollers 35, 39. Such stripper members are entirely conventional. During manufacture of cartridge 1 abutment 49 is flexed into chamber 11 to provide space during assembly to position roller 39 after rollers 29 and 35 have been positioned as shown in FIG. 2. Openings 50*a* and 50*b* in bottom wall 5 under abutments 47 and 49 respectively permit mold access to fabricate abutments 47 and 49 and are not significant in the operation of the cartridge 1.

As shown in FIG. 2, a flat spring 51 of about the width of ribbon 13 is held in an L-shaped extension 53 on the inside of wall 7 and an L-shaped extension 55 on the inside of wall 7 at its other end. An extension 57 of spring 51 fits in the central region 40*a* (having no teeth) of roller 35, and is flexed to firmly bias roller 35 toward roller 39. As shown in FIG. 2 and FIG. 3, bottom wall 5 is formed in an oblong extension 59 which just fits and receives a bottom shaft 61 (FIG. 3) of roller 35. The long axis of extension 59 is directed to allow roller 35 to move generally tangentially to roller 29, so that teeth 33 remain engaged with teeth 37 as roller 35 moves because of enlargements of ribbon 13, such as those resulting from bends. When the ribbon returns to normal thickness, roller 35 is restored in position by spring member 57. (To provide a physical support against tipping of roller 35 as it moves along extension 59, top cover 3 has a depending straight ridge (not shown) parallel to extension 59 which engages the top shaft of roller 35 opposite roller 29.)

Similarly, a round extension 62 of bottom wall 5 (FIG. 3) loosely receives bottom shaft 63 of roller 39 and also a vertical shaft 64 from bottom cover 5 just fits within roller 39. These permit roller 39 to rotate, but not move bodily.

In this preferred embodiment, therefore rollers 35 and 39 are identical and each is symmetrical. No top or bottom need be found for insertion as they are identical.

Chamber 11 is defined by walls 9 to be generally oval. Top wall 3 and bottom wall 5 are flat where they face chamber 11 except for a ridge on each of them to form a dam as discussed below. The height of chamber 11 is 8.6 millimeter (mm), while the height of ribbon 13 is 7.94 mm, leaving a nominal 0.66 mm clearance within chamber 11.

Figure 5:
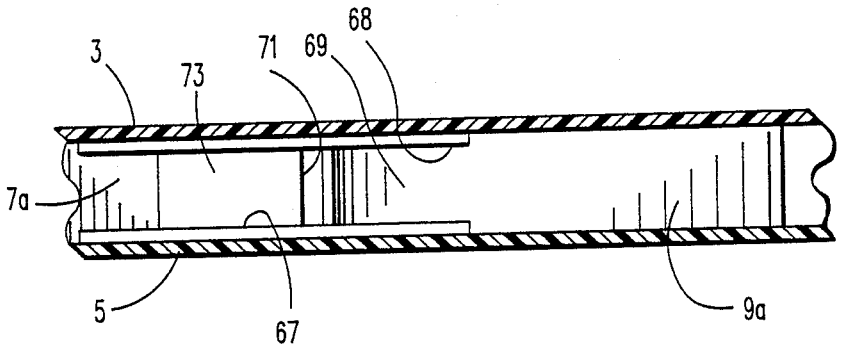
FIG. 5 is a sectional view directly toward the dam and small chamber omitting the ribbon.

The direction of forces, shown by imaginary line 65 (FIG. 1), from pinch rollers 35 and 39 is toward wall portion 9*a*. Wall portion 9*a* is straight where it faces pinch rollers 35 and 39 and forms an angle of approximately 125° clockwise between force line 65 and wall portion 9*a*. Immediately contiguous to the end of wall portion 9*a*, at an angle of 5 degrees counterclockwise from force line 65, wall 9*a* terminates and bottom wall 5 has small ridge 67 which rises 1.1 mm. Top cover 3 has an identical ridge 68 (FIG. 5) facing ridge 67, which depends downward 1.1 mm, to form with ridge 67 a dam which leaves an opening approximately 1.54 mm smaller than the height of ribbon 13, but which ribbon 13 can readily pass over by flexing. Such a dam is essentially conventional. Ridge 67 is slightly displaced outwardly from wall portion 9*a*, but extends in a straight line to the side of cartridge 1 generally on an extension of the line defined by wall portion 9*a*.

Immediately past wall portion 9*a*, is a wall portion 69 which is generally perpendicular to wall portion 9*a* and which leads to one side of a narrow slot 71 of width to permit only single strands of ribbon 13 to exit. The other side of slot 71 is defined by a wall 73 extending from the edge of cartridge 1. Walls 69 and 73 extend between top wall 3 and bottom wall 5. Walls 73, 69, 7*a* (the cartridge wall opposite wall 69) and the dam with ridges 67 and 68 (FIG. 5) form a small chamber 74 which contains loosely packed ribbon 13 which has entered from chamber 11. Slot 71 is therefore immediately contiguous to wall portion 69 and is on the side of chamber 74 near wall portion 9*a*. Single strands of ribbon 13 in chamber 74 are pulled out through slot 71. Ribbon 13 extends unimpeded from slot 71 to the surface 27 and is held against surface 27 by spring 23.

In operation cartridge 1 is installed on a printer which turns drive roller 29 clockwise (as viewed from above) to feed ribbon 13. Ribbon 13 is held between pinch rollers 35 and 39, and roller 35 is driven by roller 29. Ribbon 13 is thereby forced or stuffed into chamber 11. Chamber 11 is tightly filled with ribbon 13, which takes a generally random, folded configuration.

The dam formed by ridge 67 being positioned near obstructive wall 9*a*, is effective to meter ribbon 13 to chamber 74, where ribbon 13 then smoothly exits slot 71. Ribbon 13 passes out of arm 15 to be used for printing in the region between arms 15 and 17. Ribbon 13 is normally connected end-to-end to be continuous and is used repeatedly until ink in ribbon 13 is depleted.

This configuration permits both the drive roller 29 and the pinch roller 39 around which ribbon 13 is guided to be fixed in position within cartridge 1. Roller 35 is free to translate to accommodate bends and other high areas in ribbon 13.

Modification of this cartridge within the spirit and scope of the foregoing will be apparent.

What is claimed is:

1. A ribbon cartridge comprising two pinch rollers, a printer ribbon stuffed in said cartridge by said two pinch rollers, a first chamber into which said ribbon is stuffed, said first chamber having an obstruction wall opposite the direction of stuffing force of said two pinch rollers, a third roller in said cartridge located out of said first chamber linked to one of said pinch rollers to drive said pinch roller to which it is linked by driving movement of said third roller, at least part of said one pinch roller being located between said third roller and said first chamber, a second chamber having an exit slot, and an opening in said first chamber immediately contiguous to said wall opposite said stuffing force, said opening having a dam constricting said ribbon which permits said ribbon to exit said first chamber to be loosely contained in said second chamber and to exit said second chamber in a single strand through said exit slot, said exit slot being on the side of said second chamber near said obstruction wall such that said obstruction wall is substantially straight on a line at an obtuse angle to said direction of stuffing force and said dam is located on a line which is substantially an extension of said line of said wall.

2. A ribbon cartridge comprising two pinch rollers, a printer ribbon stuffed in said cartridge by said two pinch rollers, a first chamber into which said ribbon is stuffed, said first chamber having an obstruction wall opposite the direction of stuffing force of said two pinch rollers, a third roller in said cartridge located out of said first chamber linked to one of said pinch rollers to drive said pinch roller to which it is linked by driving movement of said third roller, at least part of said one pinch roller being located between said third roller and said first chamber, a second chamber having an exit opening, and an opening in said first chamber immediately contiguous to said wall opposite said stuffing force, said opening in said first chamber having a dam constricting said ribbon which permits said ribbon to exit said first chamber to be loosely contained in said second chamber and to exit said second chamber in a single strand through said exit opening, said obstruction wall being substantially straight on a line at an obtuse angle to said direction of stuffing force and said dam being located on a line which is substantially an extension of said line of said wall.

3. A ribbon cartridge containing a printer ribbon stuffed in a first chamber in said cartridge by two pinch rollers, an obstruction wall opposite the direction of stuffing force of said two pinch rollers, and a second chamber having a first side immediately contiguous to said wall opposite said stuffing force, said second chamber having an exit slot immediately contiguous to said first side and a dam constricting said ribbon which permits said ribbon to exit said first chamber to be loosely contained in said second chamber and to exit said second chamber in single strands through said exit slot such that said obstruction wall is substantially straight on a line at an obtuse angle to said direction of stuffing force and said dam is located on a line which is substantially an extension of said line of said wall.

4. A ribbon cartridge as in claim 3 in which the smallest angle between said direction of stuffing force and said first side of said second chamber opening is approximately 5 degrees.

5. A ribbon cartridge containing a printer ribbon stuffed in a first chamber in said cartridge by two pinch rollers, an obstruction wall opposite the direction of stuffing force of said two pinch rollers, and a second chamber having a first side immediately contiguous to said wall opposite said stuffing force, said second chamber having an exit opening near said first side and a dam constricting said ribbon which permits said ribbon to exit said first chamber to be loosely contained in said second chamber and to exit said second chamber in single strands through said exit opening, said obstruction wall being substantially straight on a line at an obtuse angle to said direction of stuffing force and said dam being located on a line which is substantially an extension of said line of said wall.

* * * * *